US008172365B2

(12) United States Patent
Sugahara

(10) Patent No.: US 8,172,365 B2
(45) Date of Patent: May 8, 2012

(54) LIQUID JETTING APPARATUS AND HEAD CARTRIDGE

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 876 days.

(21) Appl. No.: 12/056,941

(22) Filed: Mar. 27, 2008

(65) Prior Publication Data

US 2008/0238988 A1 Oct. 2, 2008

(30) Foreign Application Priority Data

Mar. 29, 2007 (JP) ..... 2007-086607

(51) Int. Cl.
*B41J 2/165* (2006.01)
*B41J 2/14* (2006.01)

(52) U.S. Cl. ..... 347/49; 347/29; 347/87

(58) Field of Classification Search ..... 347/29, 347/49, 87

See application file for complete search history.

(56) References Cited

U.S. PATENT DOCUMENTS

| | | | | |
|---|---|---|---|---|
| 5,702,511 | A | 12/1997 | de Saint-Romain et al. | |
| 6,231,156 | B1 | 5/2001 | Ono | |
| 6,796,646 | B2 * | 9/2004 | Komplin et al. | 347/86 |
| 7,695,095 | B2 * | 4/2010 | Shindo | 347/29 |

FOREIGN PATENT DOCUMENTS

| | | | |
|---|---|---|---|
| JP | S61-181649 | A | 8/1986 |
| JP | S63-254046 | A | 10/1988 |
| JP | H02-106353 | A | 4/1990 |
| JP | H08-239611 | A | 9/1996 |
| JP | H09-300666 | A | 11/1997 |
| JP | H10-044448 | A | 2/1998 |
| JP | H11-240165 | A | 9/1999 |
| JP | 2002-166620 | A | 6/2002 |
| JP | 2003-285432 | A | 10/2003 |
| JP | 2004-163963 | A | 6/2004 |
| JP | 2005-125572 | A | 5/2005 |

OTHER PUBLICATIONS

Japan Patent Office; Notice of Reasons for Rejection in Japanese Patent Application No. 2007-086607 (counterpart to the above-captioned U.S. patent application) mailed Aug. 18, 2009.

* cited by examiner

*Primary Examiner* — Jerry Rahll
(74) *Attorney, Agent, or Firm* — Baker Botts L.L.P.

(57) ABSTRACT

A liquid jetting apparatus includes a first liquid jetting head which has a plurality of first nozzles, a head holder to which a first liquid jetting head is fixed, a liquid cartridge which is detachably mounted on the head holder, and which supplies the first liquid jetting head with a liquid which is to be jetted from the first nozzles, and a head cartridge which has a second liquid jetting head having a plurality of second nozzles, and a liquid tank which supplies the second liquid jetting head with a liquid which is to be jetted from the second nozzles. The second liquid jetting head and the liquid tank are integrated to form the head cartridge, and the head cartridge is detachably mounted on the head holder.

13 Claims, 11 Drawing Sheets

LIQUID JETTING APPARATUS AND HEAD CARTRIDGE

CROSS REFERENCE TO RELATED APPLICATION

The present application claims priority from Japanese Patent Application No. 2007-086607, filed on Mar. 29, 2007, the disclosure of which is incorporated herein by reference in its entirety.

BACKGROUND OF THE INVENTION

1. Field of the Invention

The present invention relates to a liquid jetting apparatus which jets a liquid from nozzles and a head cartridge which is used in the liquid jetting apparatus.

2. Description of the Related Art

In image forming apparatuses which form images on recording mediums such as recording papers, an image forming apparatus which jets, on recording mediums, an authentication ink such as an ink which includes DNA is available. For example, in an image forming apparatus described in Japanese Patent Application Laid-open No. 2005-125572, DNA which is synthesized in a DNA synthesizer, and an ink as a coating material are mixed in a DNA ink mixing chamber, and the DNA ink is jetted from an ink-jet head. Furthermore, in an image forming apparatus described in Japanese Patent Application Laid-open No. 2005-125572, DNA of a different type is synthesized for each validity period in the DNA synthesizer, and before supplying this DNA ink to the DNA ink mixing chamber, cleaning of the DNA ink mixing chamber is carried out by discharging the ink remained in the DNA ink mixing chamber.

However, in the image forming apparatus described in Japanese Patent Application Laid-open Publication No. 2005-125572, the DNA ink in the DNA ink mixing chamber is not removed completely just by discharging the ink in the DNA ink mixing chamber, and there is a possibility that the DNA which is supplied to the DNA ink mixing chamber subsequently and the DNA which is remained in the DNA ink mixing chamber are mixed. Moreover, if the different DNAs are mixed, there is a possibility that the validities (expiry dates) are wrongly identified when the DNA ink jetted from the ink-jet head is analyzed. Here, cleaning the DNA ink mixing chamber in addition to discharging the ink in the DNA ink mixing chamber may be taken into consideration as a cleaning operation which is to be carried out before supplying a different DNA to the DNA ink mixing chamber. However, in this case, a mechanism for cleaning the inside of the DNA ink mixing chamber is necessary, and a structure of the entire apparatus becomes complicated.

As it has been described above, a problem which arises due to mixing of inks when the ink to be used differs from an ink used previously, is not limited to a case in which a DNA ink is used. For example, a similar problem arises in a case in which physical properties change upon a chemical reaction when the ink to be used is mixed with the ink which has been used previously. Whereas, the ink-jet head has a plurality of liquid jetting systems (a plurality of channel systems which are mutually independent, as channel systems from a common ink chamber up to nozzles via pressure chambers), but the problem of mixing of inks does not arise in all the liquid jetting systems.

SUMMARY OF THE INVENTION

An object of the present invention is to provide a liquid jetting apparatus which is capable of preventing different liquids from being mixed and jetted, without complicating a structure of the entire apparatus.

According to a first aspect of the present invention, there is provided a liquid jetting apparatus including a first liquid jetting head which has a plurality of first nozzles from which a liquid is jetted; a head holder to which the first liquid jetting head is fixed; a liquid cartridge which is detachably attached to the head holder, and which supplies the liquid to the first liquid jetting head to be jetted from the first nozzles; and a head cartridge having a second liquid jetting head which has a plurality of second nozzles from which a liquid is jetted, and a liquid tank which supplies the liquid to the second liquid jetting head to be jetted from the second nozzles, wherein the second liquid jetting head and the liquid tank are integrally formed to be the head cartridge, and the head cartridge is detachably attached to the head holder.

When the second liquid jetting head is due to jet liquid inks of different types which should not be mixed, if the second liquid jetting head cannot be removed from the head holder, and only the liquid cartridge which supplies the liquid to the second liquid jetting head is detachable, the following inconvenience will occur. Namely, when the liquid cartridge is replaced by another cartridge filled with a different liquid, a liquid supplied from the second liquid cartridge which is replaced with the another cartridge is remained in the second liquid jetting head. Therefore, the remaining liquid and the different liquid supplied from the another cartridge are mixed. Moreover, for preventing such different liquids from being mixed, it is necessary to carry out cleaning of the second liquid jetting head at the time of replacing the liquid cartridge, and to provide a mechanism for cleaning to the liquid jetting apparatus.

However, in the present invention, since the head cartridge is detachable, by replacing the head cartridge, the second liquid jetting head is also replaced together with the second liquid cartridge. Consequently, it is possible to prevent the different liquids from being mixed. Moreover, the mechanism for cleaning the second liquid jetting head is also unnecessary, and the structure of the overall apparatus becomes simple.

Whereas, since the head cartridge in which the liquid jetting head and the liquid tank are integrated is expensive, when all the liquid jetting heads are let to be the head cartridge, it costs substantially to replace the liquid jetting heads. However, in the present invention, regarding the first liquid jetting head, since the jetting of different liquids, which should not be mixed, is not due, the first liquid jetting head is fixed to the head holder to be non-replaceable. On the other hand, only a comparatively inexpensive liquid cartridge is detachably provided to the head holder thereby suppressing a rise in the cost. Moreover, since the second liquid jetting head is replaceable together with the liquid tank as an integrated head cartridge, a problem of mixing of different liquids can be avoided.

In the liquid jetting apparatus of the present invention, the liquid jetted from the second nozzles of the second liquid jetting head may be an authentication ink which is used to authenticate a printing person of a printed matter. Accordingly, in a case of jetting the authentication ink onto the recording medium, and authenticating the printing persons by the authentication ink which is adhered to the recording medium, the authentication ink is to be changed for each printing person of the printed matter. Therefore different authentication inks are not mixed due to replacing the head cartridge. Consequently, the authentication ink other than that of the printing person is not adhered to the printed matter, and it is possible to authenticate accurately the printing person of the printed matter. Authenticating the printing person of the printed matter includes not only authenticating the printing person of the printer matter, but also authenticating a group etc. to which the printing person of the printed matter belongs.

In the liquid jetting apparatus of the present invention, the authentication ink may be a DNA ink. In a case in which the authentication ink is a DNA ink, when different DNA inks are mixed and that ink is adhered to the recording medium, there is a possibility that it is not possible to authenticate (identify) accurately the printing person of the printed matter even if the DNA ink adhered to the printed matter is analyzed. However, in the present invention, the different DNA inks are not mixed by replacing the head cartridge, and it is possible to authenticate accurately the printing person of the printed matter.

The liquid jetting apparatus of the present invention may further include a first cap which covers the first nozzles; and a second cap which covers the second nozzles of the head cartridge when the head cartridge is attached to the head holder. In this case, by providing the first cap and the second cap separately, when the first nozzles and the second nozzles are covered by the first cap and the second cap respectively, a liquid in one liquid jetting head is prevented from adhering to the other liquid jetting head, and the different liquids are prevented from being mixed.

In the liquid jetting apparatus of the present invention, the second cap may face the second liquid jetting head of the head cartridge when the head cartridge is attached to the head holder, the cap may have a plurality of cap covers which are stacked for covering a surface of the second liquid jetting head; and the cap covers may be removable one by one. When one cap provided to the image forming apparatus is used in common for the plurality of cartridges containing different types of liquids and attached to the head holder, there is a possibility that the liquid of the head cartridge before replacement is adhered to the cap and the adhered ink is adhered to a head cartridge after the replacement, and that the different liquids are mixed. However, in the present invention, since the plurality of cap covers mutually stacked cover a surface of the second cap facing the head cartridge, it is possible to prevent from adhering to the second liquid jetting head, the liquid of the other second liquid head, by removing one of the plurality of cap covers at the time of replacing the head cartridge.

In the liquid jetting apparatus of the present invention, the second cap may be replaceable. When one cap which is provided to the image forming apparatus is used in common for the plurality of head cartridges of different types of liquids, which is attached to the head holder, there is a possibility that the liquid of the head cartridge before replacement, which has been adhered to the cap, is adhered to the head cartridge after the replacement, and that the different liquids are mixed. However, in the present invention, since the second cap is replaceable, it is possible to prevent from adhering to the second liquid jetting head, the liquid of the other liquid jetting head, by replacing the second cap at the time of replacing the head cartridge.

In the liquid jetting apparatus of the present invention, the head cartridge may include a third cap which is movable between a capping position at which the third cap covers the second nozzles and an uncapping position at which the third cap does not cover the second nozzles. When one cap which is provided to the image forming apparatus is used in common for the plurality of head cartridges of different types of liquids, there is a possibility that the liquid of the head cartridge before replacement, which has been adhered to the cap, is adhered to the head cartridge after replacement, and that the different liquids are mixed. However, in the present invention, since the head cartridge has the third cap, a liquid of different type is prevented from being adhered to the second liquid jetting head.

The liquid jetting apparatus of the present invention may further include a cap opening and closing mechanism which opens and closes the third cap of the head cartridge when the head cartridge is attached to the head holder. When a user opens and closes the cap, there is a possibility that the liquid is adhered to, for example, a hand of the user. However, since the opening and closing of the cap of the head cartridge which is attached to the head holder is carried out by the cap opening and closing mechanism, the user is not required to open and close the cap, and it is possible to prevent the liquid from being adhered to hand of the user.

The liquid jetting apparatus of the present invention may further include a reciprocating mechanism which reciprocates the head holder in a predetermined direction. Accordingly, in the liquid jetting apparatus which jets liquids from the first liquid jetting head and the second liquid jetting head while reciprocating the head holder in the predetermined direction by the reciprocating mechanism, since the liquid cartridge is attached to the head holder, a tube for connecting the first ink jetting head and the liquid cartridge is not required. Accordingly, it is possible to decrease the number of components.

In the liquid jetting apparatus of the present invention, the liquid cartridge may be provided as a plurality of individual liquid cartridges; when the plurality of individual liquid cartridges are attached to the head holder and the head cartridge is attached to the head holder, the individual liquid cartridges and the head cartridge may be arranged in the predetermined direction; and the head cartridge may be positioned at an outermost side with respect to the predetermined direction than the individual liquid cartridges. Accordingly, it is possible to attach head cartridges which jet different types of liquids to the head holder, and out of the first liquid cartridges and the head cartridge, since the head cartridge is positioned at the outermost side with respect to the predetermined direction, by attaching a label etc. on a side surface of the head cartridge, the user is able to identify easily the type of the head cartridge attached to the head cartridge attachment section.

According to a second aspect of the present invention, there is provided a head cartridge which is detachably installed in a liquid jetting apparatus, the head cartridge including: a liquid jetting head which has a plurality of nozzles; a liquid tank which supplies a liquid to the liquid jetting head; and a cap which covers the nozzles, and the liquid jetting head and the liquid tank are integrally formed, and the cap is movable between a capping position at which the cap covers the nozzles and an uncapping position at which the cap does not cover the nozzles.

According to the head cartridge of the second aspect of the present invention, when the head cartridge is installed in the liquid jetting apparatus, it is possible to cover the plurality of nozzles by the cap. Therefore, it is possible to prevent the liquid inside the liquid jetting head from drying, and to prevent the liquid from being jetted inadvertently from the nozzles of the head.

The head cartridge of the present invention, may further include a bias applying member which applies bias on the cap toward the capping position and maintains the cap at the capping position. In this case, the head cartridge may include a rotating shaft which rotatably supports the cap with respect to the head cartridge, and the bias applying member may be a spring which applies bias on the rotating shaft. Moreover, the cap may be positioned at the capping position when the head cartridge is detached from the liquid jetting apparatus; and the cap may move to the uncapping position by being engaged with an engaging member which is provided to the liquid jetting apparatus when the head cartridge is attached to the liquid jetting apparatus. Moreover, the liquid may be a DNA ink. In these cases, it is possible to prevent the liquid inside the liquid jetting head from drying when the head cartridge is removed from the liquid jetting apparatus, and to prevent the liquid from being jetted inadvertently from the nozzles of the head. Moreover, when the head cartridge is installed in the liquid jetting apparatus, since the cap moves to the uncapping position by being engaged with the engaging member provided to the liquid jetting apparatus, the nozzles are exposed, and it is possible to jet the liquid.

BRIEF DESCRIPTION OF THE DRAWINGS

FIG. 7B is mounted on a printer, where, FIG. 8A shows a state of an ink-jet head in a printing position and FIG. 8B shows a state of the ink-jet head at an outer side of the printing position;

DETAILED DESCRIPTION OF THE PREFERRED EMBODIMENTS

Figure 1A:
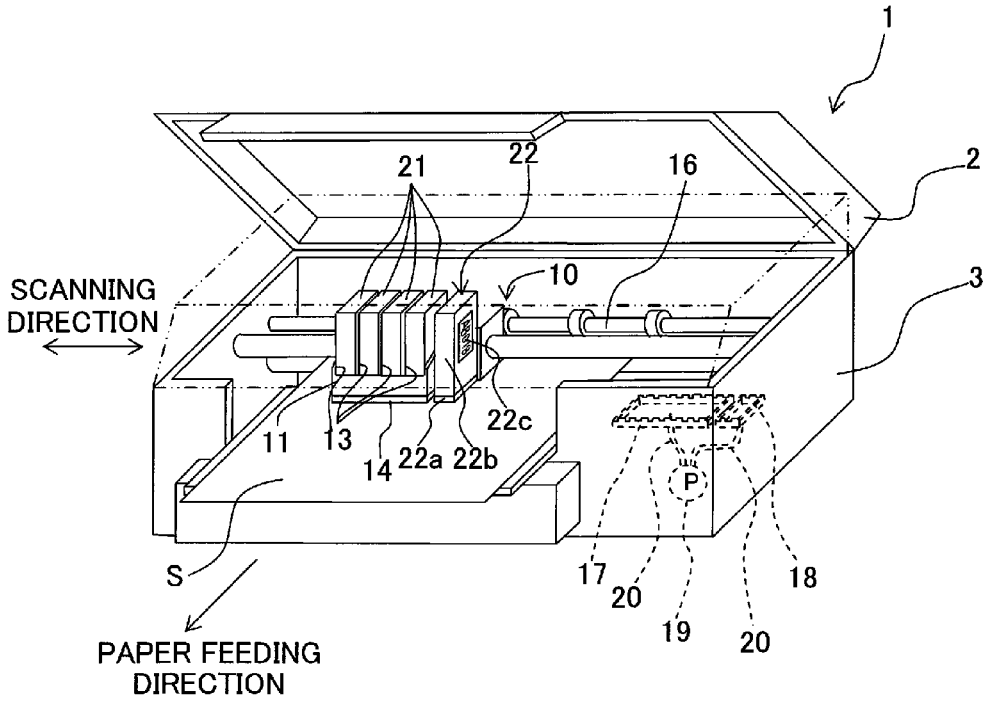
FIG. 1A and FIG. 1B are schematic structural views of a printer according to an embodiment of the present invention.
Figure 1B:
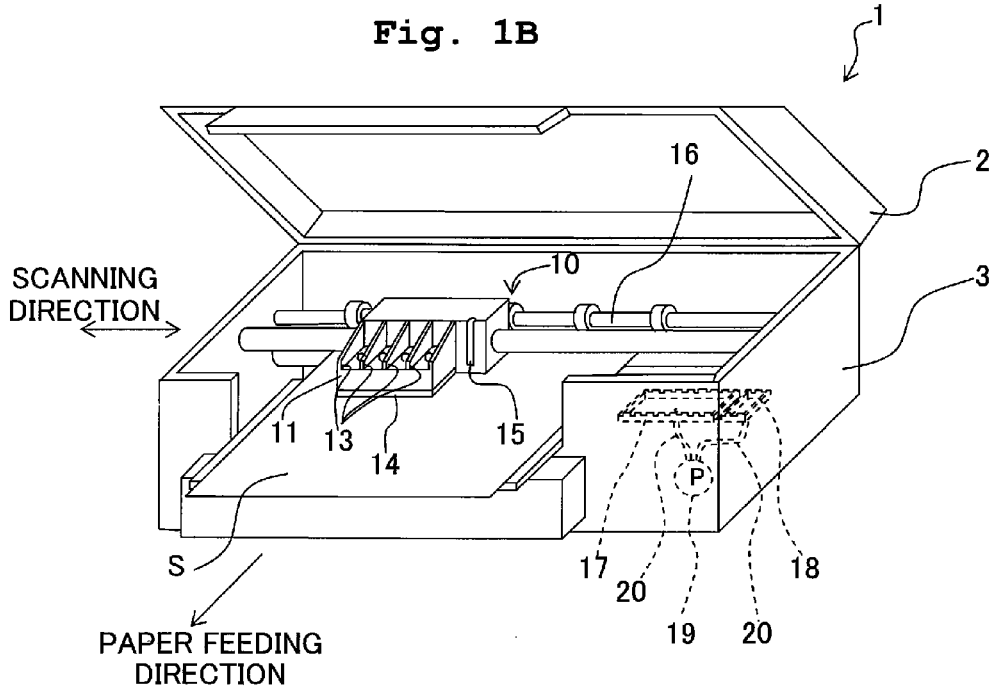

A preferred embodiment of the present invention will be described below. FIG. 1A and FIG. 1B are schematic structural views of a printer according to the embodiment, where, FIG. 1A shows a state in which a head cartridge 22 and an ink cartridge 21 which will be described later are mounted (installed), and FIG. 1B shows a state in which the head cartridge 22 and the ink cartridge 21 are not mounted.

As shown in FIG. 1A and FIG. 1B, a printer 1 has a structure in which an upper portion of a main body 3 is covered by a lid 2, and the lid 2 is openable as shown by solid line and two dot chain line in FIG. 1A. A user opens the lid 2 and replaces the ink cartridge 21 and the head cartridge 22 which will be described later. An inner side of the main body 3 is provided with a carriage 10 (reciprocating mechanism), an ink-jet head 14, a paper transporting roller 16, caps 17 and 18, and a suction pump 19.

The carriage 10 reciprocates in a left and right direction (scanning direction) in FIG. 1, and a carriage base 11 (head holder) is provided at a front end portion thereof in FIGS. 1A and 1B. An ink-jet head 14 is fixed to a lower surface of the carriage base 11, and the carriage base 11 includes four cartridge attachment sections 13 and a head cartridge attachment section 15.

Figure 3:
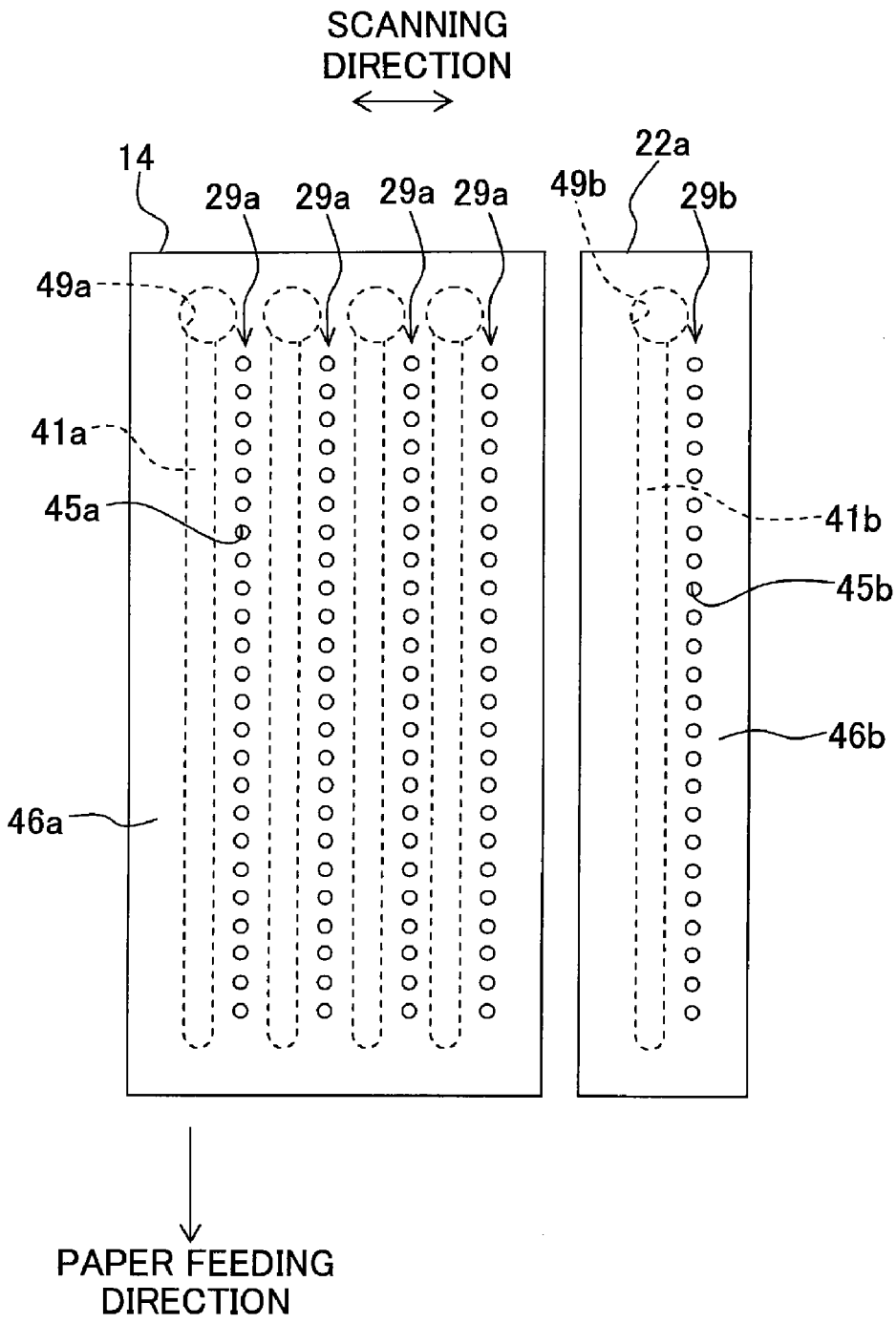
FIG. 3 is a plan view of an ink-jet head and the head cartridge in FIG. 1A and FIG. 1B.

The ink-jet head 14 jets an ink from nozzles 45*a* formed in a lower surface thereof (refer to FIG. 3). The four (ink) cartridge attachment sections 13 are provided to be aligned in the scanning direction on an upper surface of the carriage bade 11, and ink cartridges 21 filled with inks of black, yellow, cyan, and magenta color are detachably mounted on respective ink cartridge attachment sections 13 in order from a left side in the diagram. Accordingly, the ink of these four colors are supplied to the ink-jet head 14, and the ink of these four colors are jetted from the nozzles 45*a* (refer to FIG. 3).

In this manner, since the cartridge attachment section 13 is provided to the carriage base 11, by mounting the ink cartridge 21 on the cartridge attachment section 13, the inks filled in the ink cartridges 21 are supplied to the ink-jet head 14. Consequently, unlike in a case in which, the ink cartridges 21 are mounted on an external side of the carriage base 11, a tube for connecting the ink cartridge 21 and the ink-jet head 14 is unnecessary, and a structure becomes simple.

The head cartridge attachment section 15 is provided on a portion of the carriage base 11, on a right side of the ink-jet head 14 and the head cartridge attachment section 15, and the head cartridge 22 is detachably attached to the head cartridge attachment section 15. The head cartridge 22 is a cartridge in which an ink jet head 22*a* (second ink jet head) which jets a DNA ink, and an ink tank 22*b* which is provided at an upper portion of the ink jet head 22*a* and which supplies the DNA ink to the ink jet head 22*a*, are integrated. Moreover, when the head cartridge 22 is attached to the head cartridge attachment section 15, an ink jetting surface 46*a* which is a lower surface of the ink-jet head 14 (refer to FIG. 3) and an ink jetting surface 46*b* which is a lower surface of the ink jet head 22*a* (refer to FIG. 3) are positioned on the same plane.

Here, in a case in which, instead of the head cartridge 22 detachably attached to the head cartridge attachment section 15, the ink-jet head which jets the DNA ink to the carriage base 11 is fixed, and a cartridge attachment section on which an ink cartridge filled with the DNA ink is provided at an upper portion of the ink-jet head, when the ink cartridge which is attached to the cartridge attachment section is replaced by an ink cartridge filled with a different DNA ink, the DNA ink of the ink cartridge before the replacement is remained in the ink-jet head, and DNA inks of different types are mixed. In this state, when the DNA ink is discharged from the ink-jet head, and the DNA ink is adhered to a recording paper S, when the DNA ink adhered to a printed matter is analyzed, there is a possibility that a printing person of the printed matter cannot be identified accurately.

For preventing the different DNA inks from mixing, it is necessary to clean the ink-jet head at the time of attaching an ink cartridge filled with a different DNA ink on the cartridge attachment section. However, in this case, it is necessary to provide a mechanism for cleaning, to the printer 1, and a structure of the printer 1 becomes complicated.

Whereas, in this embodiment, the head cartridge 22 is attached to the head cartridge attachment section 15. When the head cartridge 22 is replaced by a cartridge which jets different DNA ink, the ink jet head 22*a* is also replaced together with the ink tank 22*b*. Therefore, a problem of mixing of different DNA inks as it has been mentioned above does not arise.

In addition to the head cartridge 22, if the ink-jet head 14 which jets the inks of four colors is integrated with the ink tanks as a head cartridge such as the head cartridge 22, since the head cartridge is expensive, a cost for replacing the head cartridge becomes substantial. However, in the embodiment, with respect to the ink-jet head 14 which jets the inks of same four colors all the time, only the ink-cartridges 21 which are comparatively inexpensive are replaceable.

Moreover, with respect to an ink-jet head which jets different DNA inks according to users or user groups, the head cartridge 22 in which the ink jet head 22*a* and the ink tank 22*b* are integrally formed is replaceable. Accordingly, it is possible to suppress an increase in the cost of replacing the ink cartridge 21 and the head cartridge 22.

Moreover, on a right-side surface in FIG. 1 of the head cartridge 22, a label 22*c* is affixed. The label 22*c* indicates a type of the DNA ink to be jetted from the head cartridge 22 and a type of the head cartridge 22. Here, with the respective ink cartridges 21 attached to the four cartridge attachment sections 13, and the head cartridge 22 attached to the head cartridge attachment section 15, the four ink cartridges 21 and the head cartridge 22 are arranged in the scanning direction, and among these, the head cartridge 22 is positioned at a right end (outermost side) as shown in FIG. 1A. The user is able to distinguish easily a type of the head cartridge 22 attached to the head cartridge attachment section 15 by checking visually the indication on the label 22*c*.

The paper transporting roller 16 transports the recording paper S in a frontward direction (paper feeding direction) in FIG. 1A and FIG. 1B. Moreover, in the printer 1, by jetting the ink from the ink jet heads 21 and 22*a* which move in the scanning direction together with the carriage 10, onto the recording paper S transported in the paper feeding direction by the paper transporting roller 16, an image is recorded on the recording papers, and also the DNA ink is adhered to the recording paper S.

A cap 17 is provided on a right side of a position at which the printing by the printer 1 is carried out, and is structured to be movable in a vertical direction. Moreover, when the ink-jet head 14 has come up to a position facing the cap 17 by the movement of the carriage 10 in the scanning direction, the cap 17 moves upward and covers the ink jetting surface 46*a* of the ink-jet head 14 (refer to FIG. 3). Due to the nozzles 45*a* being covered by the cap 17, the ink inside the ink-jet head 14 is prevented from drying.

A cap 18 is arranged at a right side of the cap 17, and is structured to be movable in the vertical direction. Moreover, when the head cartridge 22 has come to a position facing the cap 18 by the movement of the carriage 10 in the scanning direction, the cap 18 moves upward and covers the ink-jetting surface 46*b* of the head cartridge 22. Due to the nozzles 45*b* being covered by the cap 18, the ink inside the ink-jet head 22*a* is prevented from drying. When the ink-jet head 14 has come to the position facing the cap 17, the ink jet head 22*a* attached to the ink-jet head attachment section 15 also comes to the position facing the cap 18.

The suction pump 19 communicates with the caps 17 and 18 via two tubes 20 respectively. With the ink jetting surfaces 46*a* and 46*b* covered by the caps 17 and 18 respectively, by sucking air in a space surrounded by the cap 17 and the ink jetting surface 46*a* and a space surrounded by the cap 18 and the ink jetting surface 46*b*, air pressures in these spaces are decreased. Accordingly, the inks in the ink-jet heads 14 and 22*a* are sucked from the nozzles 45*a* and 45*b* respectively, and thickened ink and air bubbles in the ink etc. inside the ink-jet heads 14 and 22*a* are discharged.

In this manner, since the cap 17 covering the ink jetting surface 46*a* and the cap 18 covering the ink jetting surface 46*b* are provided separately, when the ink jetting surfaces 46*a* and 46*b* are covered by the caps 17 and 18, and when the ink is sucked from the ink-jet heads 14 and 22*a*, DNA ink adhered to the cap 18 is not adhered to the ink jetting surface 46*a*. Accordingly, when the other user carries out printing by replacing the head cartridge 22 attached to the head cartridge attachment section 15, since the DNA ink of the head cartridge 22 before replacing has not been adhered to the ink jetting surface 46*a*, the DNA ink is not adhered to the printed matter together with the inks of four colors which are jetted from the nozzles 45*a* of the ink-jet head 14. In other words, DNA ink other than the DNA ink in the head cartridge 22 attached to the head cartridge attachment section 15 is not adhered to the printed matter, and it is possible to detect accurately the printing person of the printed matter by analyzing the DNA ink on the printed matter.

Here, the cap 18 which covers the ink jetting surface 46*b* of the head cartridge 22 attached to the head cartridge attachment section 15 will be described below in detail. FIG. 2 is a cross-sectional view with respect to the scanning direction of the cap 18 in FIG. 1. As shown in FIG. 2, the cap 18 has a cap main body 18*a* which covers the ink jetting surface 46*b* of the head cartridge 22, and a connecting portion 18*b* which protrudes downward from a substantially central portion of a lower surface of the cap main body 18*a*, and which is connected to the tube 20 by being inserted into the tube 20. Moreover, a through hole 18*c*, which extends vertically from a substantially central portion of an upper surface of the cap main body 18*a* up to a lower end of the connecting portion 18*b* to penetrate the cap 18, is formed in the cap 18. The upper surface of the cap main body 18*a* and the tube 20 communicate via the through hole 18*c*, and the ink inside the ink-jet head 22*a* is sucked through the through hole 18*a* as described above.

Figure 2C:
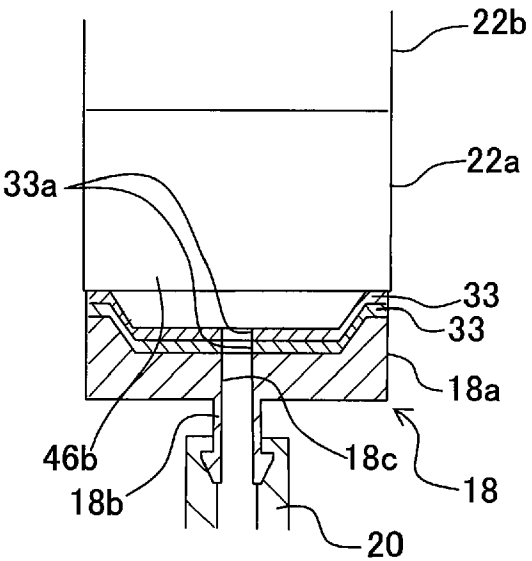
FIG. 2A to FIG. 2C are cross-sectional views showing a structure of a cap which covers an ink jetting surface of a head cartridge in FIG. 1.
Figure 2B:
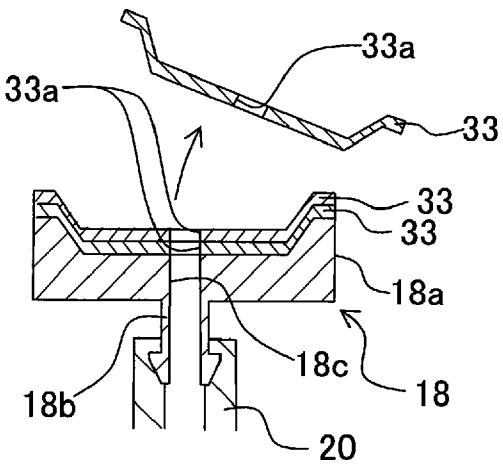
Figure 2A:
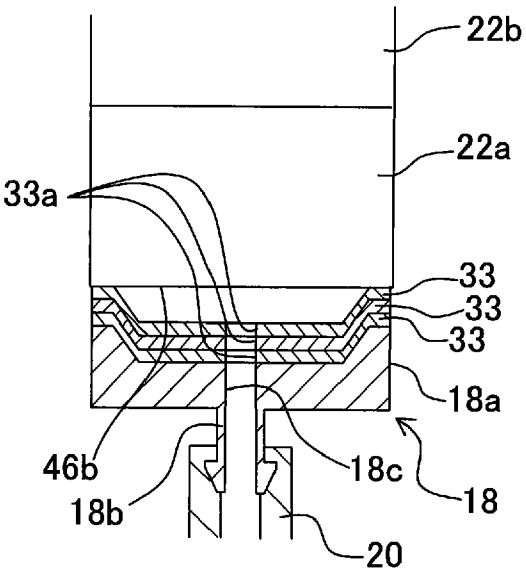

Further, a plurality of cap covers 33 are stacked mutually on the upper surface of the cap 18. A through hole 33*a* which communicates with the through hole 18*c* is provided at a substantially central portion of each of the cap covers 33. In FIG. 2A, from among the plurality of cap covers 33, three cap covers 33 are shown. When the ink jetting surface 46*b* is covered by the cap 18, the cap cover 33 positioned at the top from among the plurality of cap covers 33 makes a contact with the ink jetting surface 46*b* as shown in FIG. 2A. Moreover, it is possible to remove the cap covers 33 one by one in order from the cap cover 33 positioned at the top, and the head cartridge 22 attached to the head cartridge attachment section 15 is replaced with another head cartridge 22, the cap cover 33 positioned at the top is removed as shown in FIG. 2B.

Here, in a case in which the cap cover 33 is not provided and the upper surface of the cap 18 makes a contact directly with the ink jetting surface 46*b*, when the head cartridge 22 attached to the head cartridge attachment section 15 is replaced with another head cartridge 22 which discharges a different DNA ink, and when the ink jetting surface 46*b* of the head cartridge 22 after the replacement is covered by the cap 18, there is a possibility that the DNA ink of the head cartridge 22 before replacing, adhered to the cap is adhered to the ink jetting surface 46*b* of the head cartridge 22 after the replacement. Moreover, when the DNA ink is jetted from the nozzles 45*b* with the different DNA ink adhered to the ink jetting surface 46*b*, the DNA ink of the different type adhered to the ink jetting surface 46*b* is also adhered simultaneously to the recording paper S. Accordingly, when the DNA ink of the printed material is analyzed, there is a possibility that the printing person of the printed material cannot be identified accurately.

Whereas, in this embodiment, the cap cover 33 is removably provided to the cap 18. Therefore, when the head cartridge 22 attached to the head cartridge attachment section 15 is replaced with another head cartridge 22, it is possible to remove the cap cover 33 at the uppermost position to which the DNA ink of the head cartridge 22 before the replacement is adhered. Consequently, when the ink jetting surface 46*b* of the head cartridge 22 after the replacement is covered by the cap 18, as shown in FIG. 2C, another cap cover 33 which is positioned at the uppermost position after the removing of the upper most cap cover 33 described above, makes a contact with the ink jetting surface 46*b*. Since the DNA ink of the head cartridge 22 before the replacement is not adhered to this cap cover 33, the DNA ink of the head cartridge 22 before the replacement is not adhered to the ink jetting surface 46*b* of the head cartridge after the replacement.

Figure 4:
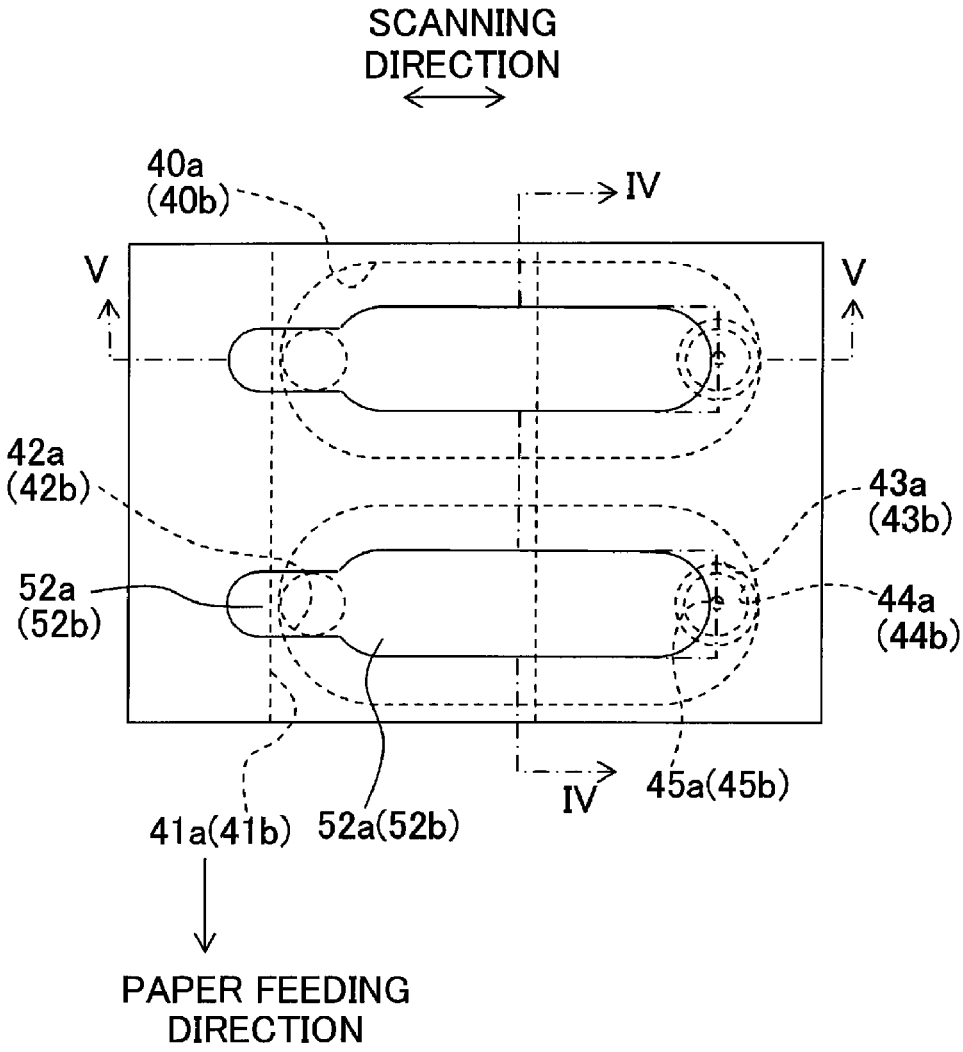
FIG. 4 is a diagram in which, a portion of two adjacent pressure chambers in a paper feeding direction in FIG. 2A to FIG. 2C, is enlarged.
Figure 5:
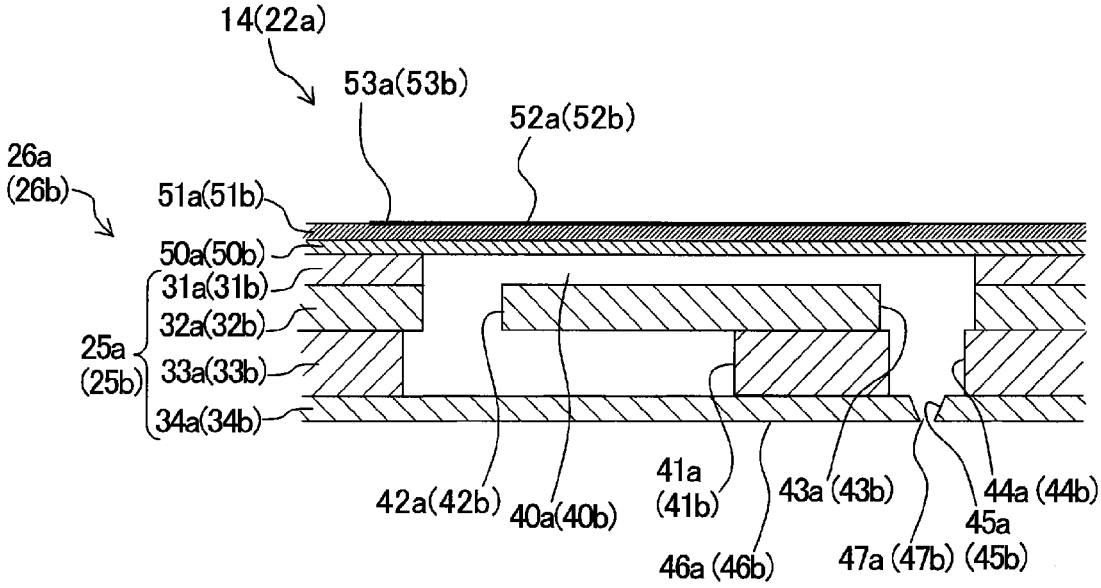
FIG. 5 is a cross-sectional view taken along a line V-V in FIG. 4.
Figure 6:
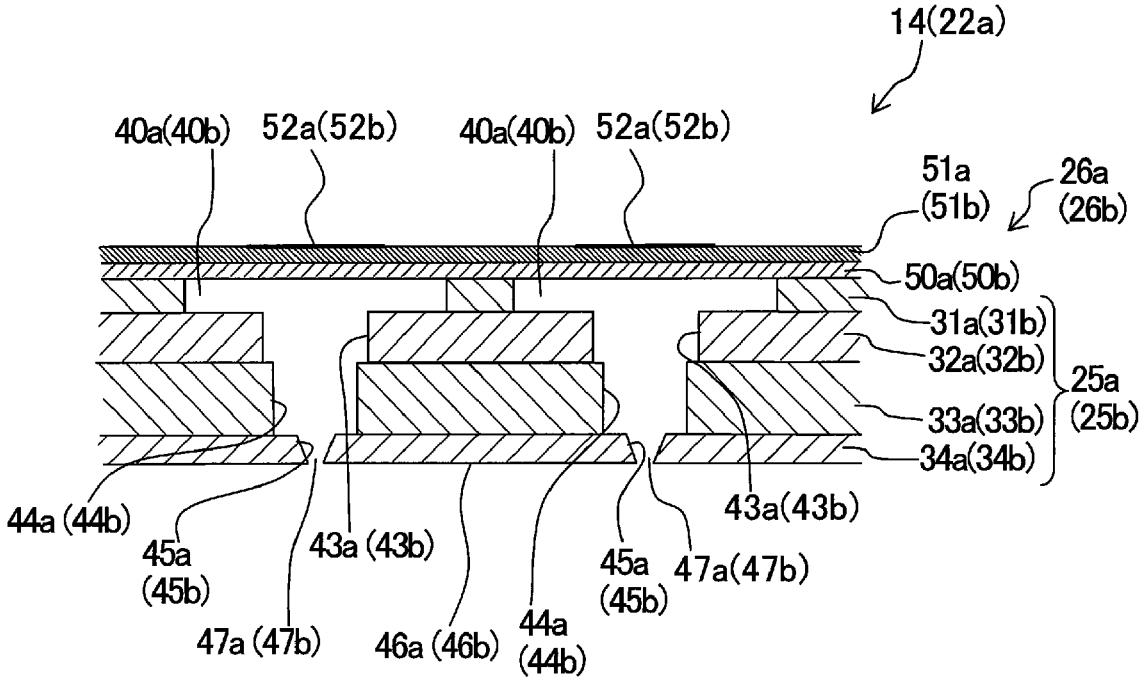
FIG. 6 is a cross-sectional view taken along a line VI-VI in FIG. 4.

Next, a structure of the ink-jet head 14 and the ink-jet head 22*a* will be described below. FIG. 3 is a plan view of the ink-jet heads 14 and 22*a*. FIG. 4 is a plan view showing two individual ink channels which are adjacent in the paper feeding direction, in the ink-jet head 14 and 22*a* in FIG. 3. FIG. 5 is a cross-sectional view taken along a line V-V in FIG. 4. FIG. 6 is a cross-sectional view taken along a line VI-VI in FIG. 4. For making the diagrams easily understandable, in FIG. 3, pressure chambers 40*a*, 40*b* etc. are omitted in the diagram, and the nozzles 45*a* and 45*b* are shown to be larger than in reality. Moreover, regarding FIG. 4 to FIG. 6, since the ink-jet head 14 and the ink-jet head 22*a* have the similar structures, reference numerals are indicated in brackets for the ink-jet head 22*a*, and the description is made by using the same diagram.

The ink-jet head 14, as shown in FIG. 3 to FIG. 6, includes a channel unit 25*a* in which ink channels such as the plurality of nozzles 45*a* and the pressure chambers 40*a* are formed, and a piezoelectric actuator 26*a* which is arranged on an upper surface of the channel unit 25*a*, and which applies a pressure for jetting to the ink in the pressure chamber 40*a*.

The channel unit 25*a* includes in order from the top, a cavity plate 31*a*, a base plate 32*a*, a manifold plate 33*a*, and a nozzle plate 34*a*, and these four plates are joined in stacked layers. From among these four plates 31*a* to 34*a*, the three plates 31*a* to 33*a* except the nozzle plate 34*a* are formed of a metallic material such as stainless steel, and the nozzle plate 34*a* is made of a synthetic resin material such as polyimide. Alternatively, the nozzle plate 34*a* may also be formed of a metallic material, similar to the other plates.

The plurality of nozzles 45*a* (first nozzles) are formed in the nozzle plate 34*a*, and a lower surface thereof is the ink jetting surface 46*a* in which jetting ports 47*a* of the nozzles 45*a* are formed. The nozzles 45*a* are arranged in the paper feeding direction (vertical direction in FIG. 3), thereby forming a nozzle row 29*a*. There are four such nozzle rows 29*a* arranged along the scanning direction (left and right direction in FIG. 3). Inks of black, yellow, cyan, and magenta colors in order from a left side in FIG. 3 are jetted from the nozzles 45*a* forming each of the nozzle rows 29*a*.

In the cavity plate 31*a*, the plurality of pressure chambers 40*a* corresponding to the plurality of nozzles 45*a* are formed. Each of the pressure chambers 40*a* has a substantially elliptical flat shape with the scanning direction as a longitudinal direction (long axis of the ellipse), and arranged such that a right end portion of the pressure chamber 40*a* and the nozzle 45*a* overlap in a plan view. Through holes 42*a* and 43*a* are formed in the base plate 32*a*, at positions overlapping with both end portions in the longitudinal direction of the pressure chamber 40*a* in a plan view.

Four manifold channels 41*a* extending in the paper feeding direction are formed on a left side of each nozzle row 29*a* in a plan view, corresponding to the four nozzle rows 29*a*. Each manifold channel 41*a* overlaps with a substantial left-half portion of each of the corresponding pressure chambers 40*a* in a plan view. An ink supply port 49*a* is formed at an upper end portion in FIG. 3 of each of the manifold channels 41*a*. When the ink cartridge 21 is attached to the cartridge attachment section 13, a space of the ink cartridge 21 in which the ink is filled communicates with the ink supply port 49*a*. Accordingly, the ink filled in the ink cartridge 21 is supplied from the ink supply port 49*a* to the manifold channel 41*a*. Moreover, through holes 44*a* are formed in the manifold plate 33*a*, at a position overlapping with the through holes 43*a* and the nozzles 45*a* in a plan view.

In such channel unit 25*a*, each of the manifold channels 41*a* communicates with the pressure chambers 40*a* via the through holes 42*a*, and each of the pressure chambers 40*a* communicates with one of the nozzles 45*a* via the through holes 43*a* and 44*a*. In this manner, in the channel unit 25*a*, a plurality of individual ink channels each of which starts from an outlet of the manifold channel 41*a* and reaches the nozzle 45*a* via the pressure chamber 40*a* is formed.

Next, the piezoelectric actuator 26*a* will be described below. The piezoelectric actuator 26*a*, as shown in FIG. 5 and FIG. 6, has a vibration plate 50*a*, a piezoelectric layer 51*a*, and individual electrodes 52*a*. The vibration plate 50*a* is formed of an electroconductive material such as stainless steel, and is joined to an upper surface of the cavity plate 21*a* to cover the pressure chambers 40*a*. Moreover, the vibration plate 50*a* which is electroconductive, also serves as a common electrode for generating an electric field in the piezoelectric layer 51*a* sandwiched between the vibration plate 50*a* and each of the individual electrodes 52*a* which will be described later. The vibration plate 50*a* is kept at a ground electric potential all the time, by a driver IC which is not shown in the diagram.

The piezoelectric layer 51*a* is formed of a piezoelectric material which is mainly composed of lead zirconium titanate which is a mixed crystal of lead titanate and lead zirconate, and which is a ferroelectric substance. The piezoelectric layer 51*a* is formed continuously on an upper surface of the vibration plate 50*a*, spreading over the pressure chambers 40*a*. Moreover, the piezoelectric layer 51*a* is polarized in advance in a direction of thickness thereof.

Each of the individual electrodes 52*a* is provided corresponding to one of the pressure chambers 40*a*, on an upper surface of the piezoelectric layer 51*a*. Each of the individual electrodes 52*a* has a substantially elliptical flat shape slightly smaller than the pressure chambers 40*a*, and is arranged at a position overlapping with a substantially central portion of one of the pressure chambers 40*a* in a plan view. Each of the individual electrodes 52 is arranged such that a left-end portion with respect to scanning direction extends up to a position not overlapping with one of the pressure chambers 40*a* in a plane view in the scanning direction, and a front end portion thereof is a contact point 53*a*. The contact point 53*a* is connected to the driver IC which is not shown in the diagram via a wiring member such as a flexible printed circuit (FPC) which is not shown in the diagram, and a driving electric potential is selectively applied to each of the individual electrodes 52*a* by the driver IC.

The ink-jet head 22*a*, as shown in FIG. 3 to FIG. 6, has a channel unit 25*b* in which ink channels such as the nozzles 45*b* and the pressure chambers 40*b* are formed, and a piezoelectric actuator 26*b* which is arranged on an upper surface of the channel unit 25*b* and which applies a voltage for the jetting of the ink inside the pressure chamber 40*b*.

The channel unit 25*b* includes in order from the top, a cavity plate 31*b*, a base plate 32*b*, a manifold plate 33*b*, and a nozzle plate 34*b*, and these four plates are joined in stacked layers. These four plates are formed of materials similar to the four plates 31*a* to 34*a* described above.

The plurality of nozzles 45*b* are formed in the nozzle plate 34*b*, and a lower surface thereof is the ink jetting surface 46*b* in which jetting ports 47*b* of the nozzles 45*b* are formed. The nozzles 45*b* are arranged in the paper feeding direction (vertical direction in FIG. 3), thereby forming a nozzle row 29*b*. A DNA ink is jetted from the nozzles 45*b*.

In the cavity plate 31*b*, the plurality of pressure chambers 40*b* each of which corresponds to one of the nozzles 45*b* are formed. Each of the pressure chambers 40*b* has a substantially elliptical flat shape with the scanning direction as a longitudinal direction, and is arranged such that a right end portion of the pressure chamber 40*b* overlaps with one of the nozzles 45*b* in a plan view. Through holes 42*b* and 43*b* are formed in the base plate 32*b*, at positions overlapping with both end portions in the longitudinal direction of each of the pressure chambers 40*b* in a plan view.

A manifold channel 41*b* which extends in the paper feeding direction is formed on a left side of the nozzle row 29*b* in a plan view. The manifold channel 41*b* overlaps with a substantial left-half portion of each of the pressure chambers 40*b* in a plan view. An ink supply port 49*b* is provided at an upper end portion in FIG. 3 of the manifold channel 41*b*, and the ink supply port 49*b* communicates with an ink tank 22*b*. Accordingly, the DNA ink filled in the ink tank 22*b* is supplied from the ink supply port 49*b* to the manifold channel 41*b*. Moreover, a through hole 44*b* is formed in the manifold plate 33*b*, at a position overlapping with each of the through holes 43*b* and each of the nozzles 45*b* in a plan view.

In such channel unit 25*b*, similarly as in the channel unit 25*a*, a plurality of individual ink channels starting from outlets of the manifold channel 41*b* and reaching the nozzles 45*b* via the pressure chambers 40*b* is formed.

Next, the piezoelectric actuator 26*b* will be described below. The piezoelectric actuator 26*b*, as shown in FIG. 5 and FIG. 6, has a vibration plate 50*b*, a piezoelectric layer 51*b*, and a plurality of individual electrodes 52*b*. The vibration plate 50*b* is formed of an electroconductive material such as stainless steel, and is joined to an upper surface of the cavity plate 31*b*, to cover the pressure chambers 40*b*. Moreover, the vibration plate 50*b* which is electroconductive, also serves as a common electrode for generating an electric field in the piezoelectric layer 51*b* by sandwiching the piezoelectric layer 51*b* between the vibration plate 50*b* and the individual electrodes 52*b* which will be described later. When the head cartridge 22 is attached to the head cartridge attachment section 15, the vibration plate 50*b* is connected to a driver IC which is not shown in the diagram, and is kept at a ground electric potential all the time.

The piezoelectric layer 51*b* is formed of a piezoelectric material similarly to the piezoelectric layer 51*a*, and is formed continuously on an upper surface of the vibration plate 50*b*, spreading over the pressure chambers 40*b*. Moreover, the piezoelectric layer 51*b* is polarized in advance in a direction of thickness thereof.

Each of the individual electrodes 52*b* is provided corresponding to one of the pressure chambers 40*b* on an upper surface of the piezoelectric layer 51*b*. Each of the individual electrode 52*b* has a substantially elliptical flat shape slightly smaller than the pressure chambers 40*b*, and is arranged at a position overlapping with a substantially central portion of one of the pressure chambers 40*b* in a plan view. Each individual electrode 52*b* is arranged such that a left end portion with respect to the scanning direction extends up to a position not overlapping with the pressure chamber 40*b* in a plan view in the scanning direction, and a front end portion thereof is a contact point 53*b*. When the head cartridge 22 is attached to the head cartridge attachment section 15, the contact point 53*b* is connected to the driver IC which is not shown in the diagram, and a driving electric potential is selectively applied to each of the individual electrodes 52*b* by the driver IC.

Here, a method for driving the piezoelectric actuators 26*a* and 26*b* will be described below. However, since the method for driving the piezoelectric actuator 26*a* and the method for driving the piezoelectric actuator 26*b* are the same, only the method for driving the piezoelectric actuator 26*a* will be described below.

In the piezoelectric actuator 26*a*, each of the individual electrodes 52*a* is kept at the ground electric potential in advance. When a driving electric potential is applied to one of the individual electrode 52*a* from the driver IC, an electric potential difference is developed between the individual electrode 52*a* to which the driving electric potential is applied and the vibration plate 50*a* serving as the common electrode. Accordingly, an electric field in the direction of thickness is generated in a portion of the piezoelectric layer 51*a* sandwiched between the individual electrode 52*a* and the vibration plate 50*a*. Since a direction of the electric field is parallel to the polarization direction of the piezoelectric layer 51*a*, this portion of the piezoelectric layer 51*a* is contracted in a horizontal direction which is orthogonal to the direction of thickness. With the contraction of the portion of the piezoelectric layer 51*a*, a portion of the vibration plate 50*a* facing the pressure chamber 40*a* is deformed to project toward the pressure chamber 40*a*, and a volume of the pressure chamber 40*a* is decreased. Accordingly, a pressure on the ink inside the pressure chamber 40*a* is increased, and the ink is jetted from the nozzle 45*a* communicating with the pressure chamber 40*a*.

The following effect is achieved by the embodiment described above.

In a case in which an ink-jet head jetting a DNA ink is fixed to the carriage base 11 and an ink cartridge which supplies the DNA ink to this ink-jet head is replaceable, when the ink cartridge is replaced, different DNA inks are mixed in the ink-jet head. Moreover, for preventing the different DNA inks from mixing, it is necessary to provide a mechanism which cleans the ink-jet head. However, in this embodiment, since the ink-jet head 22*a* is replaced together with the ink tank 22*b* when the head cartridge 22 attached to the head cartridge attachment section 15 is replaced, the different DNA inks are not mixed at the time of replacing the head cartridge 22. Moreover, the mechanism for cleaning as described above is also unnecessary, and it is possible to make simple the structure of the printer 1.

Furthermore, the head cartridge being expensive, when a head cartridge is used not only for the head cartridge 22 which jets the DNA ink but also for the ink-jet head 14 which jets inks of four colors for forming an image, replacing the head cartridge becomes substantially expensive. However, in this embodiment, with respect to the ink-jet head 14 which jets the inks of same four colors all the time, only the ink cartridges 21 are replaceable, and the ink-jet head 22*a* and the ink tank 22*b* are integrally formed to construct the head cartridge 22 which jets the DNA ink. Therefore, it is possible to suppress from increasing a cost for replacing the head cartridge and the ink-jet head.

Moreover, by providing the cap 17 and the cap 18 separately, it is possible to prevent the DNA ink from adhering to the ink jetting surface 46*a* when the ink jetting surfaces 46*a* and 46*b* are covered by the caps 17 and 18, and when the ink inside the ink-jet heads 14 and 22 is sucked.

The plurality of cap covers 33 are stacked on the cap 18, and by removing the cap cover 33 at the uppermost position at the time of replacing the head cartridge 22, it is possible to prevent the DNA ink of the head cartridge 22 before the replacement, which is adhered to the cap cover 33, from being adhering to the head cartridge 22 after the replacement.

In the printer 1, the ink is jetted from the nozzles 45*a* and 45*b* while the ink-jet head 14 and the head cartridge 22 are made to reciprocate in the scanning direction by the carriage 10. The cartridge attachment section 13 is provided to the carriage base 11, and the ink cartridge 21 is attached to the cartridge attachment section 13, and the ink filled in the ink cartridge 21 is supplied to the ink-jet head 14. Therefore, unlike in a case in which the cartridge attachment section is at an exterior of the carriage, a tube etc. for connecting the ink-jet head 14 and the ink cartridge 21 is unnecessary.

Moreover, when the four ink cartridges 21 are attached to the four cartridge attachment sections 13, and the head cartridge 22 is attached to the head cartridge attachment section 15, the four ink cartridges 21 and the head cartridge 22 are arranged in the scanning direction, and the head cartridge 22 is positioned at a right side of this arrangement. The user is able to distinguish easily a type of the head cartridge 22 which is attached to the head cartridge attachment section 15 by checking visually the label 22*c* which is affixed to the right side surface of the head cartridge 22.

Next, modified embodiments in which various modifications are made in the embodiment will be described below. However, same reference numerals are assigned to components having a similar structure as in the embodiment, and the description of such components is omitted.

Figure 7B:
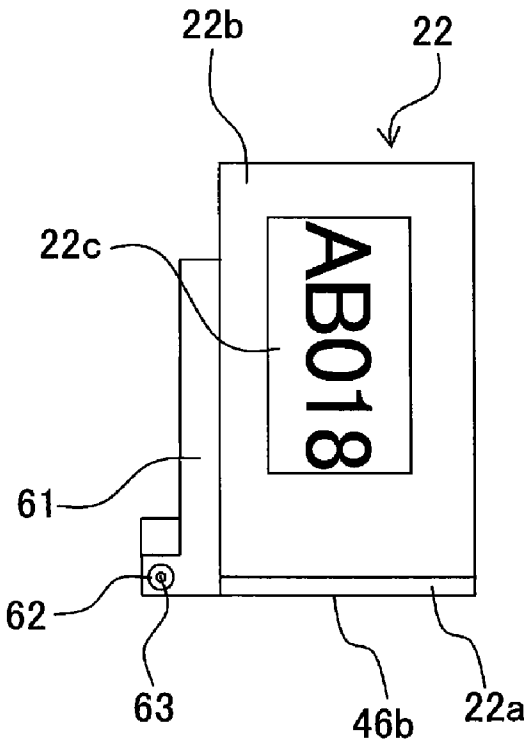
FIG. 7A and FIG. 7B are side views of a head cartridge in a first modified embodiment.
Figure 7A:
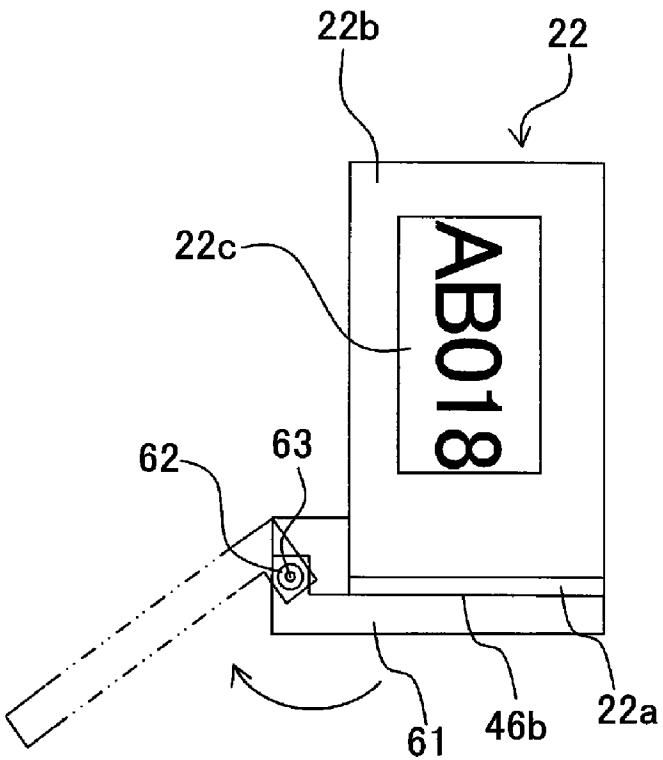

In a first modified embodiment, the head cartridge 22 includes a cap 61 (third cap) as shown in FIG. 7A to FIG. 7B. The cap 61 is rotatably supported by a rotating shaft 62 which is provided at a lower end portion on a side surface of the head cartridge 22. By rotation of the cap 61 with the rotating shaft 62 as a center, the cap 61 is rotatable between a position at which the ink jetting surface 46*b* is covered (capping position) as shown in FIG. 7A and a position at which the cap 61 does not cover the ink jetting surface 46*b* and the ink jetting surface 46*b* is exposed (uncapping position) as shown in FIG. 7B. Moreover, a bias is applied on the cap 61 by a bias applying member 63 such as a spring for example, such that the cap 61 remains at the capping position when no other external force is exerted on the cap 61. Accordingly, when the head cartridge 22 is not attached to the head cartridge attachment section 15, the ink jetting surface 46*b* is covered by the cap 61, and the ink inside the ink-jet head 22 is prevented from drying.

Figure 8A:
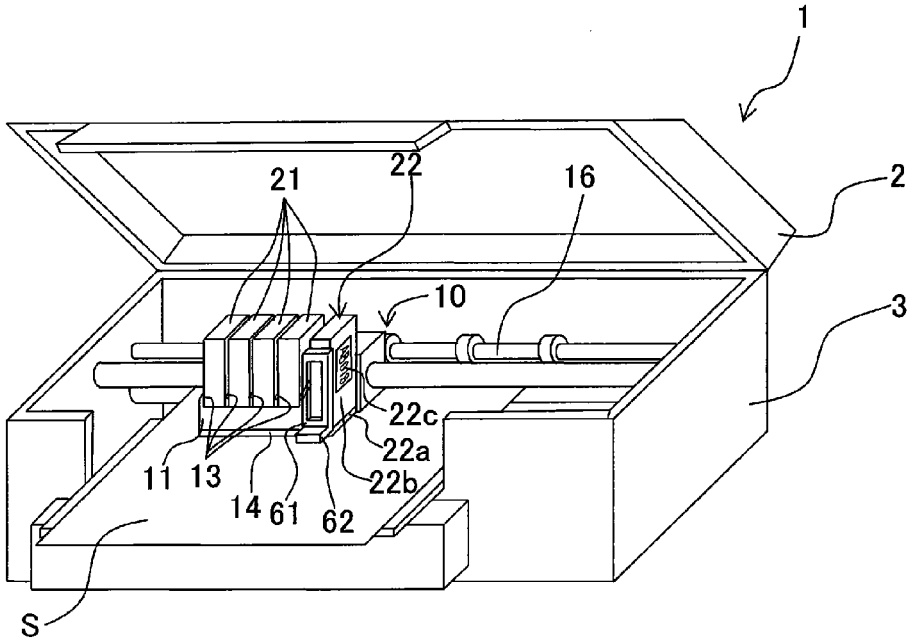
FIG. 8A and FIG. 8B are diagrams when the head cartridge in FIG. 7A

With the head cartridge 22 attached to the head cartridge attachment section 15, when the carriage 10 moves, and the ink-jet head 14 and the head cartridge 22 come to an area (printing area) facing the recording paper S as shown in FIG. 8A, immediately before coming the printing area, the cap 61 is engaged with an engaging member not shown in the diagram which is provided to the printer, and is guided by the engaging member to be moved up to the uncapping position, and the head cartridge 22 moves up to the printing area in this state. Accordingly, when the head cartridge 22 is positioned at the printing position, the ink jetting surface 46*a* is exposed, and it is possible to jet the DNA ink from the nozzles 45*b*.

Figure 8B:
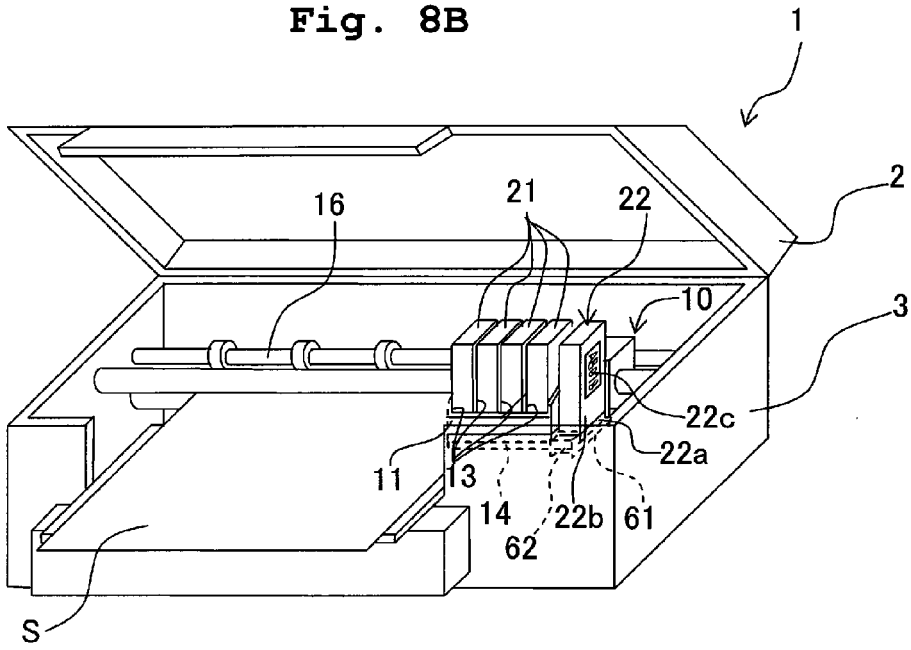

On the other hand, when the carriage 10 moves and the ink-jet head 14 and the head cartridge 22 come out of the printing area as shown in FIG. 8B, the engaging member is disengaged from the cap 61. Accordingly, the bias is applied by the spring on the cap 16 and the cap 16 is rotated (turned) to return to the capping position. Consequently, the ink jetting surface 46*b* is covered by the cap 61, and the ink inside the ink-jet head 22 is prevented from drying. At this time, the ink jetting surface 46*a* of the ink-jet head 14 is covered by a cap not shown in the diagram which is provided to the printer 1, and the ink inside the ink-jet head 14 is prevented from drying (first modified embodiment). The spring and the engaging member described above correspond to an opening and closing mechanism according to the present invention.

In this case, since the head cartridge 22 includes the cap 61 which covers the ink jetting surface 46*b* of the head cartridge 22, even when the head cartridge 22 mounted on the head cartridge attachment section 15 is replaced, the different DNA inks are not mixed. Moreover, since the cap 61 is opened and closed by the spring and the engaging member, the user is not required to carry out manually an operation such as opening the cap 61 at the time of attaching the head cartridge 22 on the head cartridge attachment section 15, and adhering of the ink to hand is prevented.

In the first modified embodiment, at the time of exposing the ink jetting surface 46*b*, the cap 61 has been rotated by about 270° in the clockwise direction from the capping position, when viewed from a right side in FIG. 8A. However, for exposing the ink jetting surface 46*b*, the cap 61 may be rotated by at least 90°.

Moreover, in the first modified embodiment in which the head cartridge 22 includes the cap 61, an arrangement may be made to be such that, when the head cartridge 22 is not attached to the head cartridge attachment section 15, the cap 61 is at the capping position, and when the head cartridge 22 is attached to the head cartridge attachment section 15, the cap 61 moves up to the uncapping position, and further, when the head cartridge 22 is removed from the head cartridge attachment section 15, the cap 61 returns once again to the capping position.

When the head cartridge 22 includes the cap 61, instead of providing the engaging member described above to the printer 1, the user may move the cap 61 up to the uncapping position by rotating the cap 61 by hand, and with the cap 61 at the uncapping position, the head cartridge 22 may be attached to the head cartridge attachment section 15.

Figure 7D:
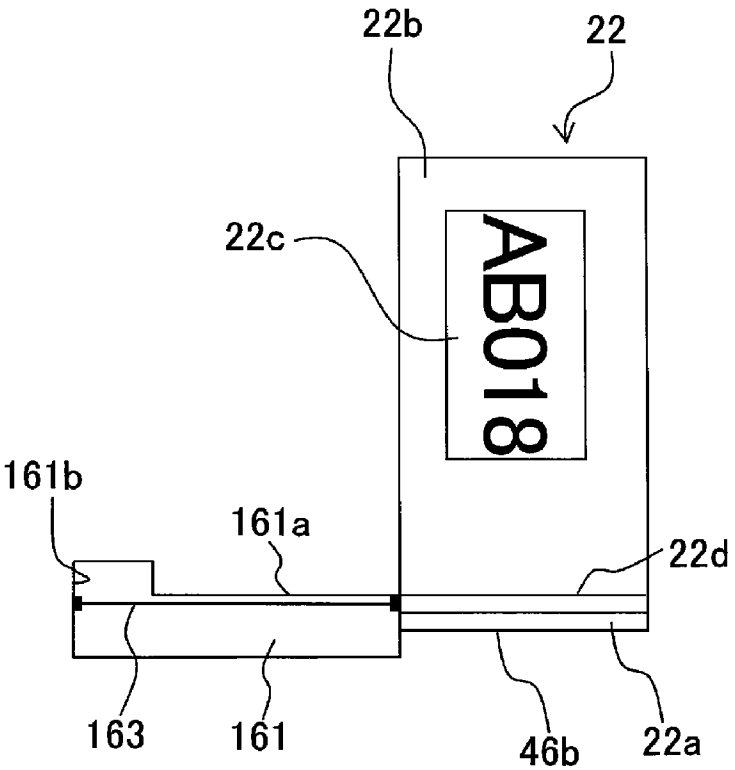
FIG. 7C and FIG. 7D are modified embodiments of the head cartridge in FIG. 7A and FIG. 7B.
Figure 7C:
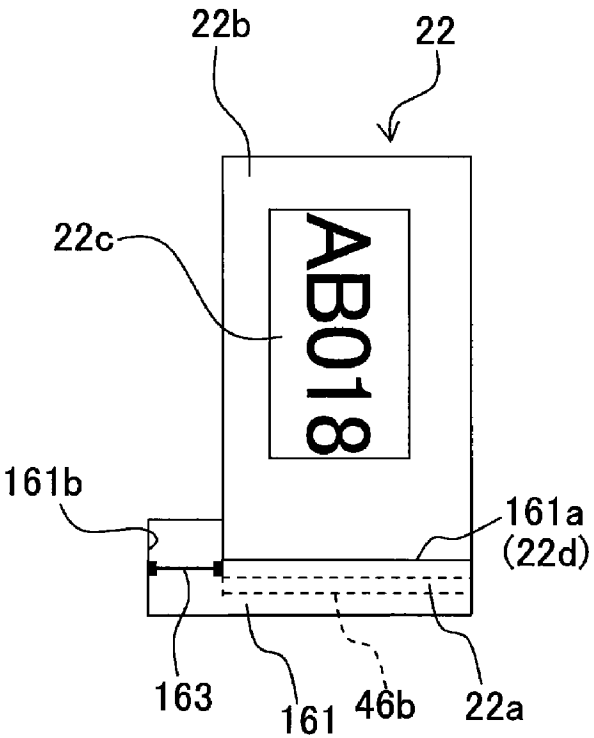

Moreover, in the first modified embodiment, the cap 61 makes a rotational movement with respect to the head cartridge 22 with the rotating shaft 62 as an axis of rotation. However, the movement of the cap 61 with respect to the head cartridge 62 is not restricted to a rotational movement. For example, as shown in FIG. 7C and FIG. 7D, a cap 161 may slide between a position covering the ink jetting surface 46*b* (FIG. 7C) and a position at which the ink jetting surface 46*b* is exposed (FIG. 7D). A groove 22*d* is formed in a side surface of the ink tank 22*b*, along the ink jetting surface 46*b*, and a projection 161*a* for engaging with the groove 22*d* is formed on an inner-side surface of the cap 161 which covers a part of the side surface of the ink tank 22*b*. Further, bias may be applied to the cap 161 by a bias applying member 163 such as a spring, with respect to the head cartridge 22.

Moreover, in the first modified embodiment, the ink inside the ink-jet head 22*a* is prevented from drying by covering the ink jetting surface 46*b* by the cap 61. However, an arrangement may be made to be such that, when head cartridge 22 is at the position in FIG. 8B, by opening a part of the cap 61, and connecting this opening portion to the suction pump 19 (refer to FIG. 1), a surface of the cap 61 facing the ink jetting surface 46*b* and the suction pump 19 communicate. Moreover, when the head cartridge 22 is removed from the head cartridge attachment section 15, the opening portion described above, of the cap 61 is closed. In this case, it is possible to use the cap 61 both as a cap for covering the ink jetting surface 46*b* and for preventing the drying of the ink inside the ink-jet head 22, and as a cap for covering the ink jetting surface 46*b* at the time of sucking the ink inside the ink-jet head 22*a*.

Figure 9:
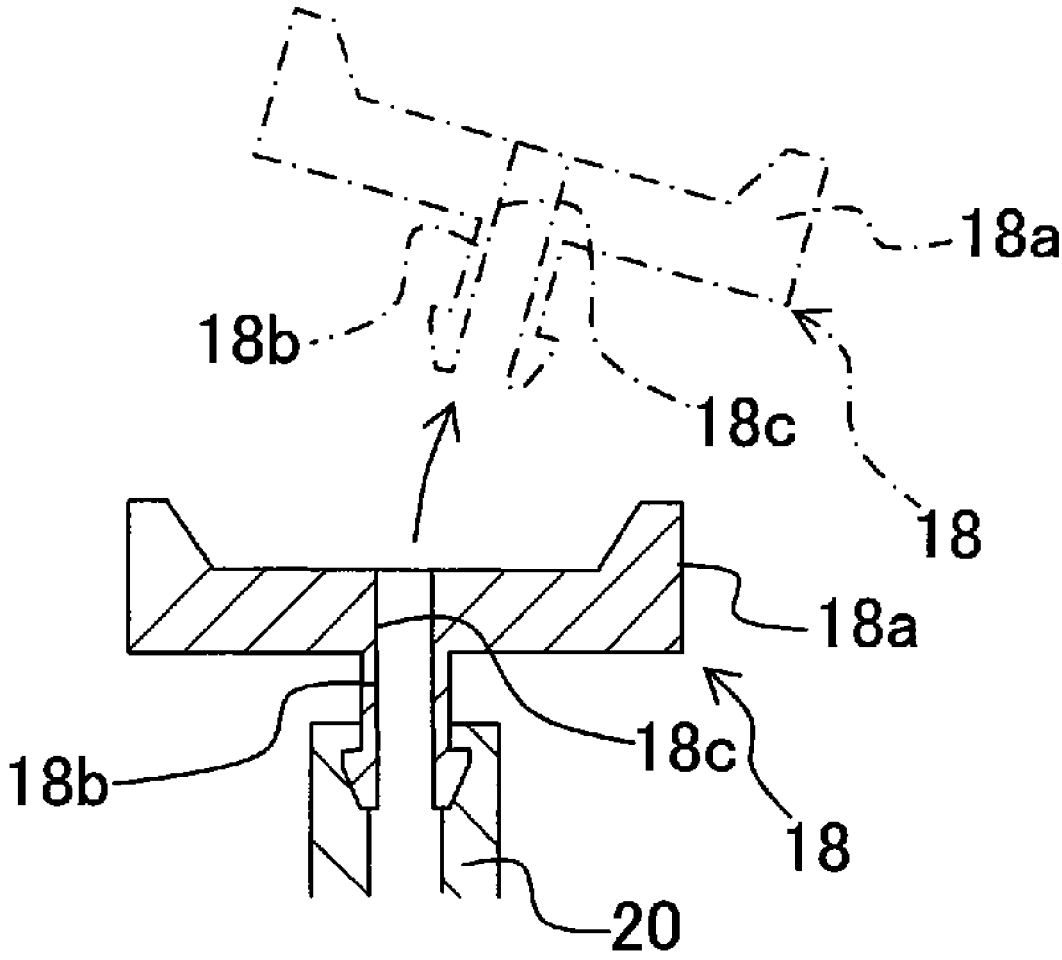
FIG. 9 is a cross-sectional view of a cap of a second modified embodiment.

In the embodiment, an arrangement is made such that the upper surface of the cap 18 has been covered by the plurality of cap covers 33, and at the time of replacing the head cartridge 22, one of the cap covers 33 is removed every time. However, the present invention is not restricted to this arrangement. For example, the cap covers 33 may not be provided to the cap 18 (refer to FIG. 2), and at the time of replacing the head cartridge 22 attached to the head cartridge attachment section 15, the cap 18 may be removed from the tube 20, and replaced by another cap 18 as shown in FIG. 9 (second modified embodiment). Even in this case, by replacing the cap 18 at the time of replacing the head cartridge 22, it is possible to prevent the different DNA inks form mixing.

Figure 10:
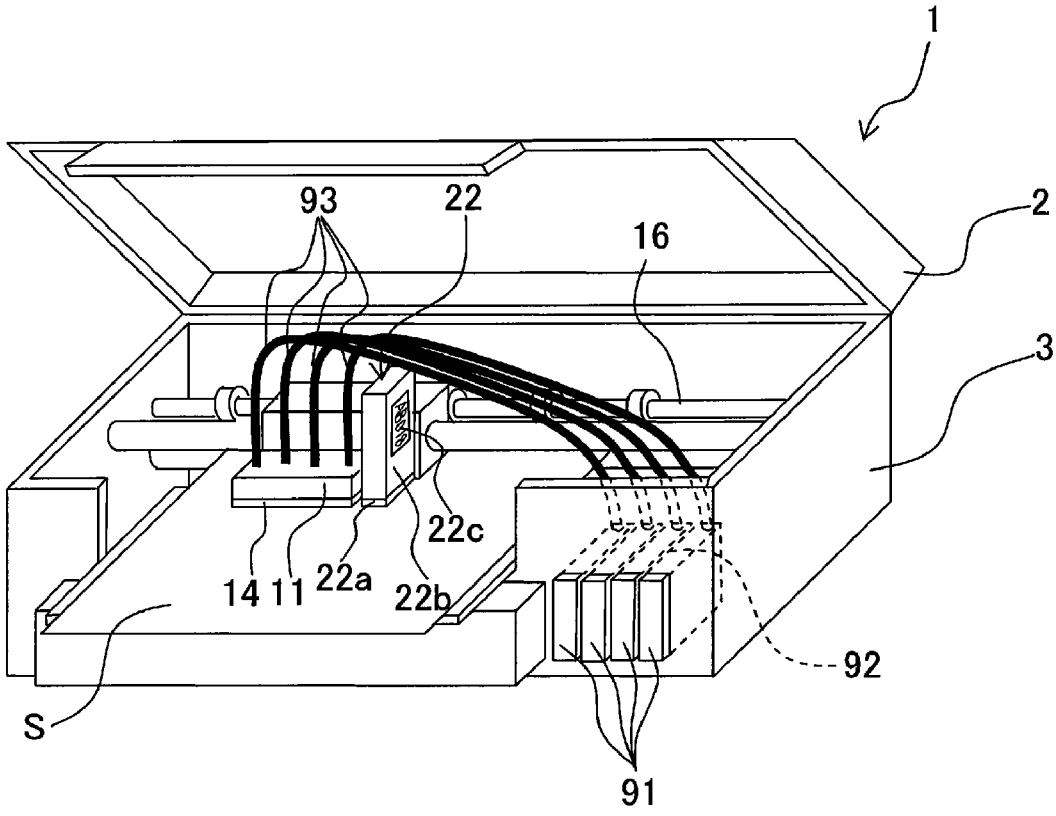
FIG. 10 is a diagram corresponding to FIG. 1B of a third modified embodiment.

In the embodiment, the ink cartridge 14 has been attached to the cartridge attachment section 13 provided on the carriage base 11. However, as shown in FIG. 10, the cartridge attachment section 13 may not be provided to the carriage base 11, and a cartridge attachment section 92 to which four ink cartridges 91 are attached may be provided at outside the carriage base 11, and a space of the ink cartridge 91 in which the ink is filled and the ink-jet head 14 may be connected by a tube 93 (third modified embodiment).

Moreover, in the embodiment, the head cartridge 22 attached to the head cartridge attachment section 15 jets the DNA ink. However, the present invention is not restricted to this, and a head cartridge 22 which jets an authentication ink for authenticating a printing person of the printed matter other than the DNA ink may be attached to the head cartridge attachment section 15. Even in this case, since the ink-jet head 22*a* is replaced together with the ink tank 22*b* by replacing the head cartridge 22, different authentication inks are not mixed.

Furthermore, the head cartridge 22 which jets an ink other than the authentication ink may be attached to the head cartridge attachment section 15. When the different inks are mixed, there is a possibility of occurrence of various problems such as initiation of a reaction by inks according to the types of inks which are jetted from the head cartridge 22. However, by replacing the head cartridge, the different inks are not mixed similarly as it has been described in the embodiment, and such problems do not occur.

In the abovementioned description, embodiments and modified embodiments in which the present invention is applied to a printer jetting inks from nozzles have been described. However, the present invention is also applicable to a liquid jetting apparatus which jets a liquid other than ink.

What is claimed is:

1. A liquid jetting apparatus, comprising:

a first liquid jetting head which has a plurality of first nozzles from which a liquid is jetted;

a head holder to which the first liquid jetting head is fixed;

a liquid cartridge which is detachably attached to the head holder, and which supplies the liquid to the first liquid jetting head to be jetted from the first nozzles; and a head cartridge comprising a second liquid jetting head which has a plurality of second nozzles from which a liquid is jetted, and a liquid tank which supplies the liquid to the second liquid jetting head to be jetted from the second nozzles, wherein the second liquid jetting head and the liquid tank are integrally formed to be the head cartridge, and the head cartridge is detachably attached to the head holder, wherein a second nozzle cap faces the second liquid jetting head of the head cartridge when the head cartridge is attached to the head holder, the second nozzle cap has a plurality of cap covers which are stacked for covering a surface of the second liquid jetting head; and the plurality of cap covers are removable one by one.

2. The liquid jetting apparatus according to claim 1, wherein the liquid jetted from the second nozzles of the second liquid jetting head is an authentication ink which is used to authenticate a printing person of a printed matter.

3. The liquid jetting apparatus according to claim 2, wherein the authentication ink is a DNA ink.

4. The liquid jetting apparatus according to claim 1, further comprising:

a first nozzle cap which covers the first nozzles; and the second nozzle cap which covers the second nozzles of the head cartridge when the head cartridge is attached to the head holder.

5. The liquid jetting apparatus according to claim 4, wherein the second nozzle cap is replaceable.

6. The liquid jetting apparatus according to claim 1, wherein the second nozzle cap is movable between a capping position at which the second nozzle cap covers the second nozzles and an uncapping position at which the second nozzle cap does not cover the second nozzles.

7. The liquid jetting apparatus according to claim 6, further comprising a cap opening and closing mechanism which opens and closes the second nozzle cap of the head cartridge when the head cartridge is attached to the head holder.

8. The liquid jetting apparatus according to claim 1, further comprising a reciprocating mechanism which reciprocates the head holder in a predetermined direction.

9. The liquid jetting apparatus according to claim 8, wherein the liquid cartridge is provided as a plurality of individual liquid cartridges; when the plurality of individual liquid cartridges are attached to the head holder and the head cartridge is attached to the head holder, the individual liquid cartridges and the head cartridge are arranged in the predetermined direction; and the head cartridge is positioned at an outermost side with respect to the predetermined direction than the individual liquid cartridges.

10. A liquid jetting apparatus, comprising:

a first liquid jetting head which has a plurality of first nozzles from which a liquid is jetted;

a head holder to which the first liquid jetting head is fixed;

a liquid cartridge which is detachably attached to the head holder, and which supplies the liquid to the first liquid jetting head to be jetted from the first nozzles; and a head cartridge comprising a second liquid jetting head which has a plurality of second nozzles from which a liquid is jetted, a liquid tank which supplies the liquid to the second liquid jetting head to be jetted from the second nozzles, a cap which is movable between a capping position at which the cap covers the second nozzles and an uncapping position at which the cap does not cover the second nozzles, and a rotating shaft which rotatably supports the cap, wherein the second liquid jetting head and the liquid tank are integrally formed to be the head cartridge, and the head cartridge is detachably attached to the head holder.

11. The liquid jetting apparatus according to claim 10, further comprising a cap opening and closing mechanism which opens and closes the second nozzle cap of the head cartridge when the head cartridge is attached to the head holder.

12. The liquid jetting apparatus according to claim 10, further comprising a reciprocating mechanism which reciprocates the head holder in a predetermined direction.

13. The liquid jetting apparatus according to claim 12, wherein the liquid cartridge is provided as a plurality of individual liquid cartridges; when the plurality of individual liquid cartridges are attached to the head holder and the head cartridge is attached to the head holder, the individual liquid cartridges and the head cartridge are arranged in the predetermined direction; and the head cartridge is positioned at an outermost side with respect to the predetermined direction than the individual liquid cartridges.

* * * * *